US009265402B2

(12) United States Patent
Klump et al.

(10) Patent No.: US 9,265,402 B2
(45) Date of Patent: Feb. 23, 2016

(54) DISHWASHER RACK ASSEMBLY WITH SUPPORT FOR LARGE AND SMALL BOWLS

(75) Inventors: James Murray Klump, Crestwood, KY (US); Stephen Froelicher, Shepherdsville, KY (US); Rebecca Lynne Hannon, South Lyon, MI (US)

(73) Assignee: General Electric Company, Schenectady, NY (US)

( * ) Notice: Subject to any disclaimer, the term of this patent is extended or adjusted under 35 U.S.C. 154(b) by 1130 days.

(21) Appl. No.: 13/109,130

(22) Filed: May 17, 2011

(65) Prior Publication Data

US 2012/0293054 A1 Nov. 22, 2012

(51) Int. Cl.
*A47L 15/50* (2006.01)

(52) U.S. Cl.
CPC ..... *A47L 15/50* (2013.01); *A47L 15/505* (2013.01)

(58) Field of Classification Search
CPC ..... A47L 15/50; A47L 15/505
USPC ..... 134/56 D, 57 D, 58 D, 201; 211/41.8, 211/41.9, 41.3, 41.4
See application file for complete search history.

(56) References Cited

U.S. PATENT DOCUMENTS

| | | | | |
|---|---|---|---|---|
| 2,987,260 | A * | 6/1961 | Sasnett | 239/231 |
| 3,124,251 | A | 3/1964 | Guth | |
| 3,454,019 | A * | 7/1969 | Leedy | A47L 15/507 134/172 |
| 4,183,437 | A * | 1/1980 | Crawford | A47L 15/50 211/41.8 |
| 2007/0247039 | A1* | 10/2007 | Anderson et al. | 312/228.1 |
| 2008/0302740 | A1* | 12/2008 | Moser et al. | 211/41.8 |
| 2008/0308510 | A1* | 12/2008 | Richardson | 211/41.9 |
| 2010/0116759 | A1* | 5/2010 | Lindgren et al. | 211/41.8 |
| 2011/0017246 | A1* | 1/2011 | Haltmayer | A47L 15/505 134/135 |

FOREIGN PATENT DOCUMENTS

| | | | |
|---|---|---|---|
| DE | 102008015715 | A1 * | 10/2009 |
| WO | WO 2009118293 | A1 * | 10/2009 |

OTHER PUBLICATIONS

Machine translation of DE 102008015715 A1, dated Oct. 2009.*

* cited by examiner

*Primary Examiner* — Joseph L Perrin
*Assistant Examiner* — Kevin G Lee
(74) *Attorney, Agent, or Firm* — Dority & Manning, P.A.

(57) ABSTRACT

A dishwasher appliance having a rack assembly that can provide support for both large and small bowls is provided. The rack assembly includes tines, referred to herein as vertical members, that can hold both large and small bowls in a vertical orientation. The rack assembly may be used in a dishwasher to provide the upper rack, lower rack, or both.

15 Claims, 5 Drawing Sheets

FIG. –1–

DISHWASHER RACK ASSEMBLY WITH SUPPORT FOR LARGE AND SMALL BOWLS

FIELD OF THE INVENTION

The present invention relates to a dishwasher appliance having a rack assembly that can provide support for both large and small bowls.

BACKGROUND OF THE INVENTION

Modern dishwashers typically include a wash chamber where e.g., detergent, water, and heat can be applied to clean food or other materials from dishes and other articles being washed. Often an upper rack assembly is disposed close to the top of the washing chamber and is used to hold glasses, cups, and other small items. Typically, a lower rack assembly is positioned near the bottom of the chamber and a considerable distance below the upper rack. This provides vertical clearance to place dishes and platters on edge (i.e. a vertical orientation) and to place food preparation bowls and pots upside-down on the lower rack for washing.

Each rack normally is supplied with an array of spaced apart, generally vertical tines or members, which support and separate the individual items. Preferably, these vertical members support and fix the position of various articles during the washing process. More specifically, it is desirable to position an article, such as a dish, so that water and detergent can access all surfaces during cleaning while also preventing movement of the dish that could lead to breaking, chipping, or other damage.

One challenge in the design of the racks and the positioning of the vertical members is the variability in the sizes of articles to be washed. The optimum spacing between adjacent vertical members for supporting thin items like dishes is much less than for supporting thick items like mixing bowls and pans. In addition, dishes, pots, and other articles to be washed can each come in a variety of different shapes. Frequently, the vertical members (e.g., tines) of a rack are in a fixed position. Accordingly, a user manipulates the orientation of dishes and other objects loaded into the rack in an effort to fill the rack with articles while also providing exposure to the washing action of the dishwasher. Alternatively, some rack assemblies may be provided with vertical members having a limited amount of adjustability in an effort to accommodate various article sizes and shapes.

Bowls are no exception to the variability a designer faces in the configuring the vertical members of a rack assembly. As with other articles, bowls can come in a variety of diameters, depths, and shapes. While bowls can be placed upside down in a rack assembly to provide exposure to the washing action of a dishwasher, this orientation can consume much needed space and thereby decrease efficiency.

Accordingly, a dishwasher rack assembly that can accommodate bowls of both large and small sizes would be useful. A rack assembly that can also provide for an efficient orientation of bowls of both large and small sizes during the washing process would be also be beneficial. Such a rack assembly that can be implemented within the space or sizes commonly applied for dishwasher appliances would be also be particularly useful.

BRIEF DESCRIPTION OF THE INVENTION

Aspects and advantages of the invention will be set forth in part in the following description, or may be obvious from the description, or may be learned through practice of the invention.

In one exemplary embodiment, the present invention provides a dishwasher rack assembly. The rack assembly includes a plurality of elongated base members extending along the horizontal direction in a parallel, spaced apart relationship. Also included are a plurality of elongated first members extending along the vertical direction in a parallel, spaced apart relationship. The first members are attached to the base members. A plurality of elongated second members extend along the vertical direction in a parallel, spaced apart relationship. The second members are also attached to the base members in an alternating manner with the first members along the horizontal direction. The second members include a first vertical section attached to the base member, a second vertical section, and a bent section positioned between, and attached to, the first vertical section and the second vertical section.

In another exemplary embodiment, the present invention provides a dishwasher having a wash chamber for the receipt of dishes. The dishwasher defines both horizontal and vertical directions. The dishwasher includes a dishwasher rack assembly movably received into the wash chamber. The dishwasher rack assembly has a plurality of pairs of vertically-oriented, spaced apart first members; and a plurality of pairs of vertically-oriented, spaced apart second members. The second members have a V-shaped section along their length that provides for the support of dishes such as e.g., larger bowls.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
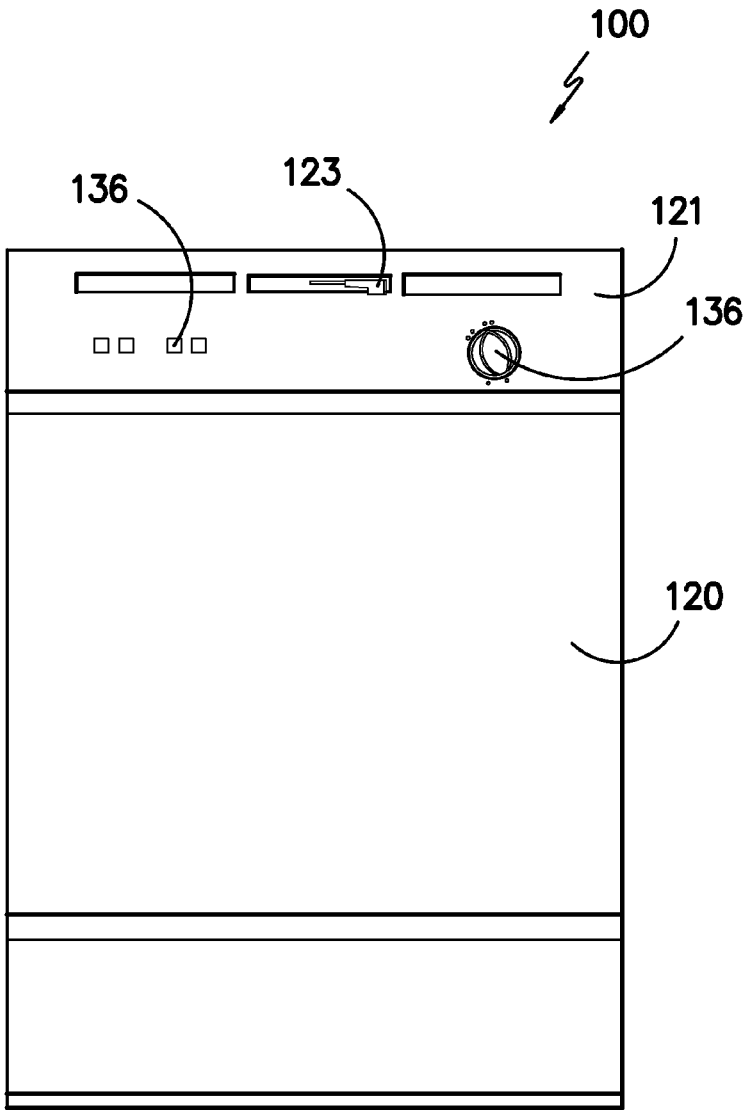
FIG. 1 provides a front view of an exemplary embodiment of a dishwasher appliance of the present invention.

The present invention relates to a dishwasher appliance having a rack assembly that can provide support for both large and small bowls. The rack assembly includes tines, referred to herein as vertical members, that can hold both large and small bowls in a vertical orientation. The rack assembly may be used in a dishwasher as the upper rack, lower rack, or both.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an exemplary domestic dishwasher 100 that may be configured in accordance with aspects of the present disclosure. For the particular embodiment of FIG. 1, the dishwasher 100 includes a cabinet 102 having a tub 104 therein that defines a wash chamber 106. The tub 104 includes a front opening (not shown) and a door 120 hinged at its bottom 122 for movement between a normally closed vertical position (shown in FIGS. 1 and 2), wherein the wash chamber 106 is sealed shut for washing operation, and a horizontal open position for loading and unloading of articles from the dishwasher. Latch 123 is used to lock and unlock door 120 for access to chamber 106.

Upper and lower guide rails 124, 126 are mounted on tub side walls 128 and accommodate upper and lower roller-equipped rack assemblies 130, 132, respectively. Each of the upper and lower racks 130, 132 is fabricated into lattice structures including a plurality of elongated members 134. Each rack 130, 132 is adapted for movement between an extended loading position (not shown) in which the rack is substantially positioned outside the wash chamber 106, and a retracted position (shown in FIGS. 1 and 2) in which the rack is located inside the wash chamber 106. This is facilitated by rollers 135 and 139, for example, mounted onto racks 130 and 132, respectively. A silverware basket (not shown) may be removably attached to the lower rack 132 for placement of silverware, utensils, and the like, that are too small to be accommodated by the upper and lower racks 130, 132.

The dishwasher 100 further includes a lower spray-arm assembly 144 that is rotatably mounted within a lower region 146 of the wash chamber 106 and above a tub sump portion 142 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located below the bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwasher 100. In the illustrated embodiment, the controller 137 may be located within a control panel area 121 of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. In one embodiment, the user interface 136 may represent a general purpose I/O ("GPIO") device or functional block. In one embodiment, the user interface 136 may include input components, such as one or more of a variety of electrical, mechanical or electromechanical input devices including rotary dials, push buttons, and touch pads. The user interface 136 may include a display component, such as a digital or analog display device designed to provide operational feedback to a user. The user interface 136 may be in communication with the controller 137 via one or more signal lines or shared communication busses.

Figure 2:
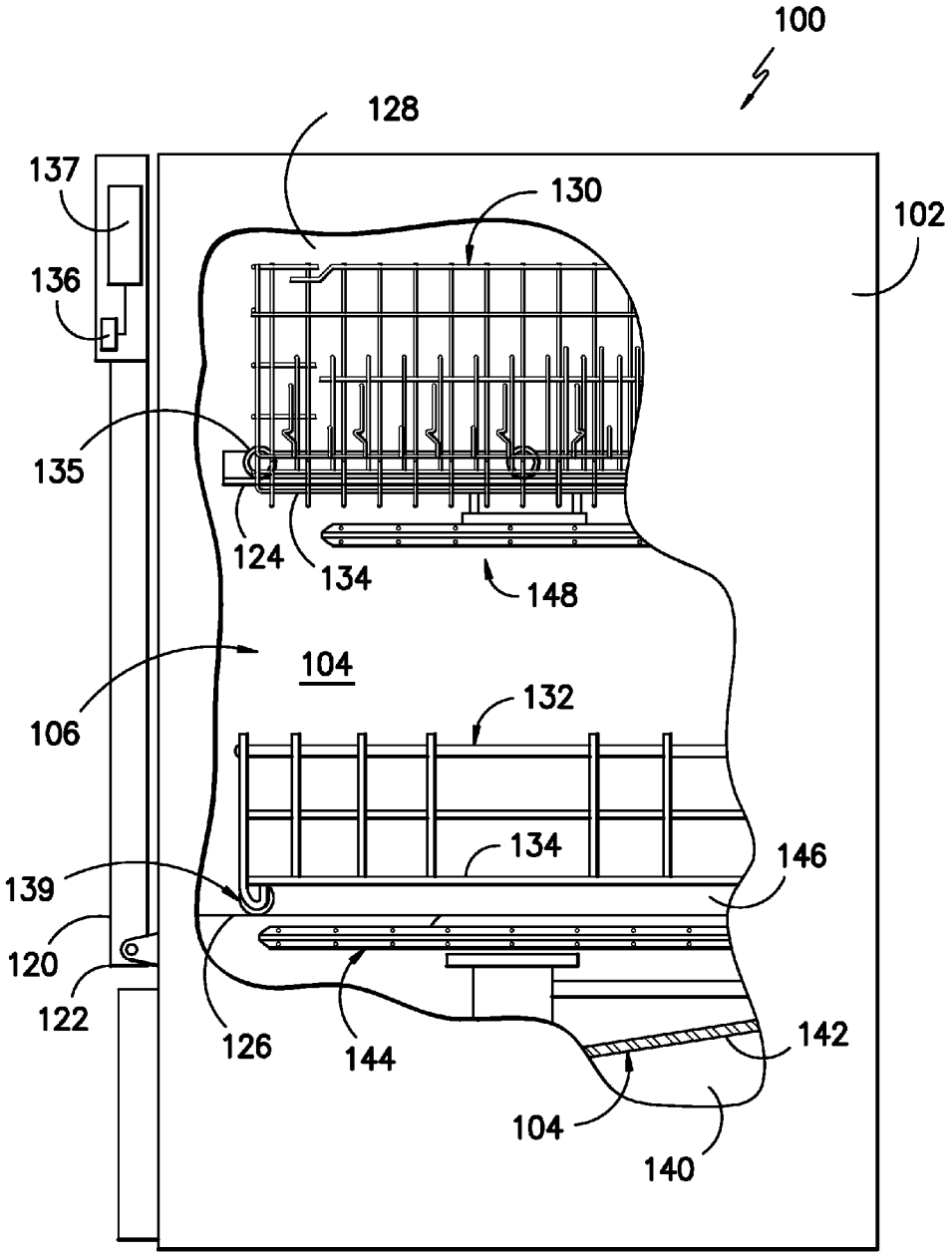
FIG. 2 provides a side view of the dishwasher of FIG. 1. A portion of the cabinet is removed to reveal the interior of the dishwasher—including portions of an exemplary embodiment of a dishwasher rack assembly of the present invention.

It should be appreciated that the invention is not limited to any particular style, model, or other configuration of dishwasher, and that the embodiment depicted in FIGS. 1 and 2 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles. Other configurations may be used as well.

Figure 3:
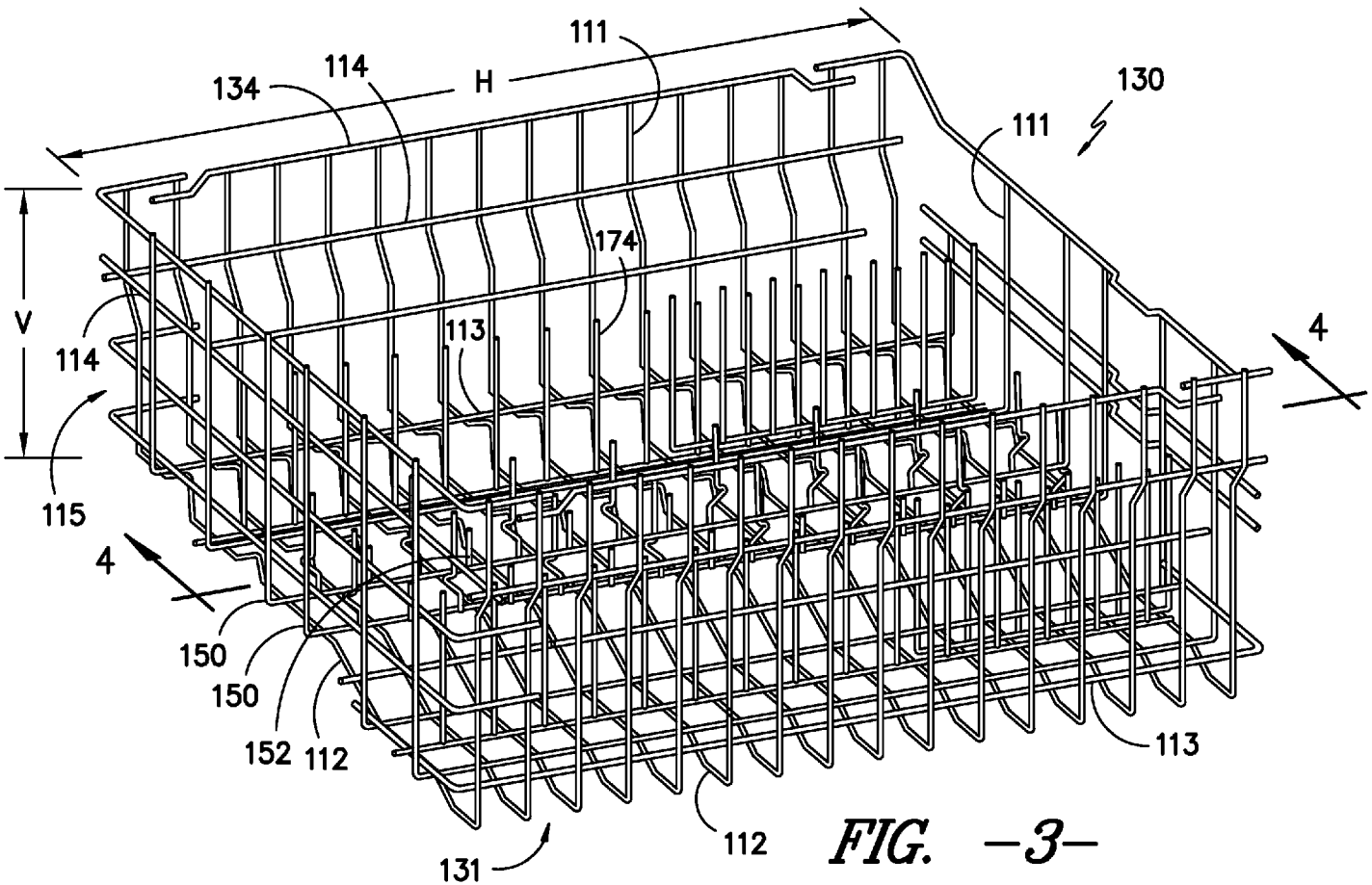
FIG. 3 is a perspective view of an exemplary embodiment of a dishwasher rack assembly of the present invention.
Figure 4:
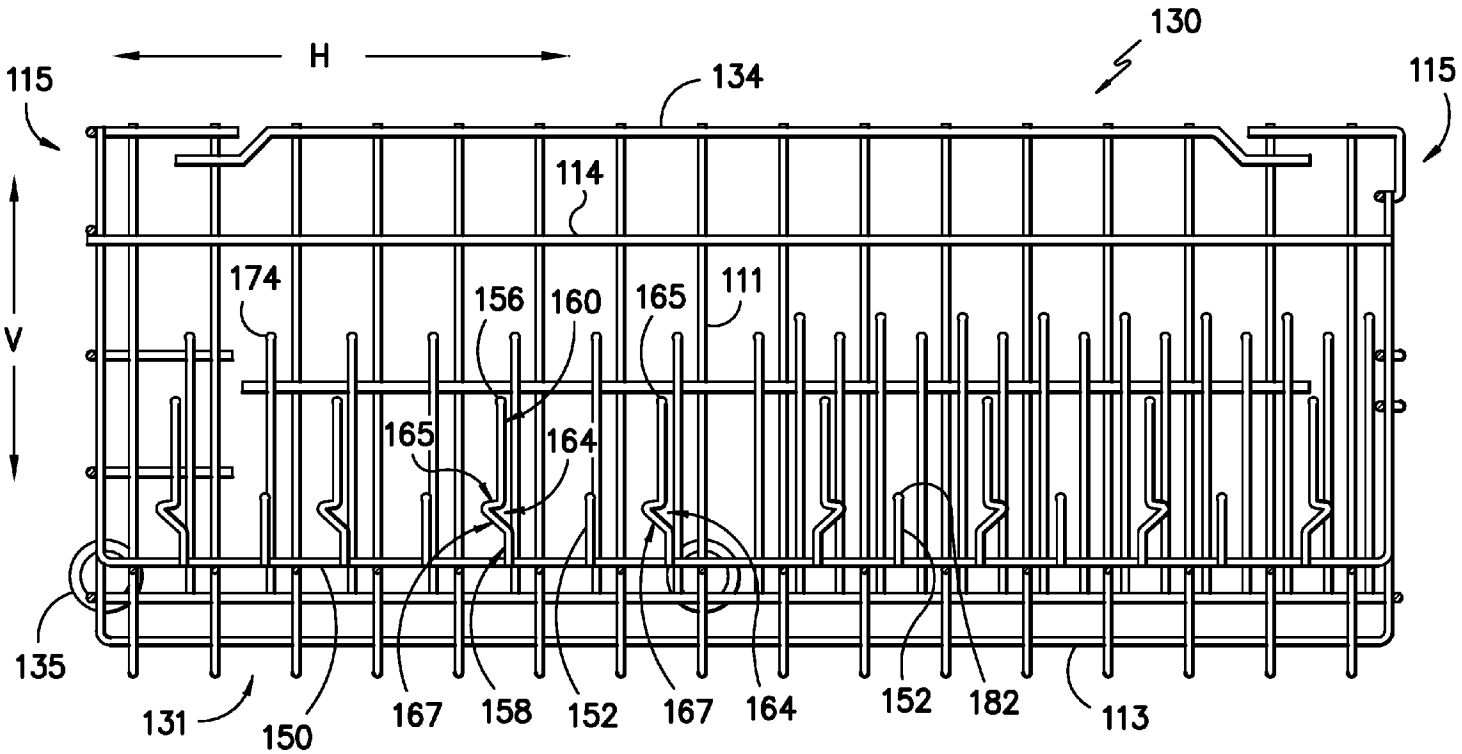
FIG. 4 is a side view of the exemplary embodiment of a dishwasher rack assembly shown in FIG. 3.

FIGS. 3 and 4 provide perspective and side views of upper rack assembly 130 in an exemplary embodiment of the present invention. An isolated view of certain elements of rack assembly 130 is set forth in FIG. 5, and these same elements are provided with slightly heavier lines in FIG. 3 in order to identify placement and context within upper rack assembly 130.

Rack 130 has a reticulated or open network construction so that wash and rinse liquid sprayed into the dishwasher chamber 106 can freely impinge upon the articles (e.g., dishes, plates, pots, cups, glasses, and other items being washed) supported upon the rack and drain back into the bottom of the chamber 106. More particularly, rack 130 is largely formed of elongated members constructed as spaced apart rods or heavy wires 134. Wires 134 can be further described as longitudinal rods or heavy wires 113 joined to spaced apart lateral rods or heavy wires 112, which extend generally perpendicular to the longitudinal rods and together form the horizontal bottom 131 of rack 130. The end portions of the rods 111 and 112 are bent to form upwardly extending rods or wires 111, defining the vertical lateral walls 115. Horizontal rods or wires 114 extend around the lateral walls and are joined to the upwardly extending rods 111 to stiffen the lateral walls 115. In addition to the vertical members specially equipped to support small and large bowls as will be further described below, multiple vertical members 174 are provided for support of articles to be washed.

Preferably the rods or wires are formed from heavy gauge metal wires or rods which are welded together into the basket configuration of rack 130 and then coated with a suitable plastic material to protect the rack from rusting and to prevent fragile glass items from resting on or hitting against hard metal. However, it will be understood that the rack may be constructed from other materials. For example, the rack can be molded as a unitary structure from a suitable plastic material such as polypropylene, for example. In that event, the wires or rods would be of a plastic material.

Figure 5:
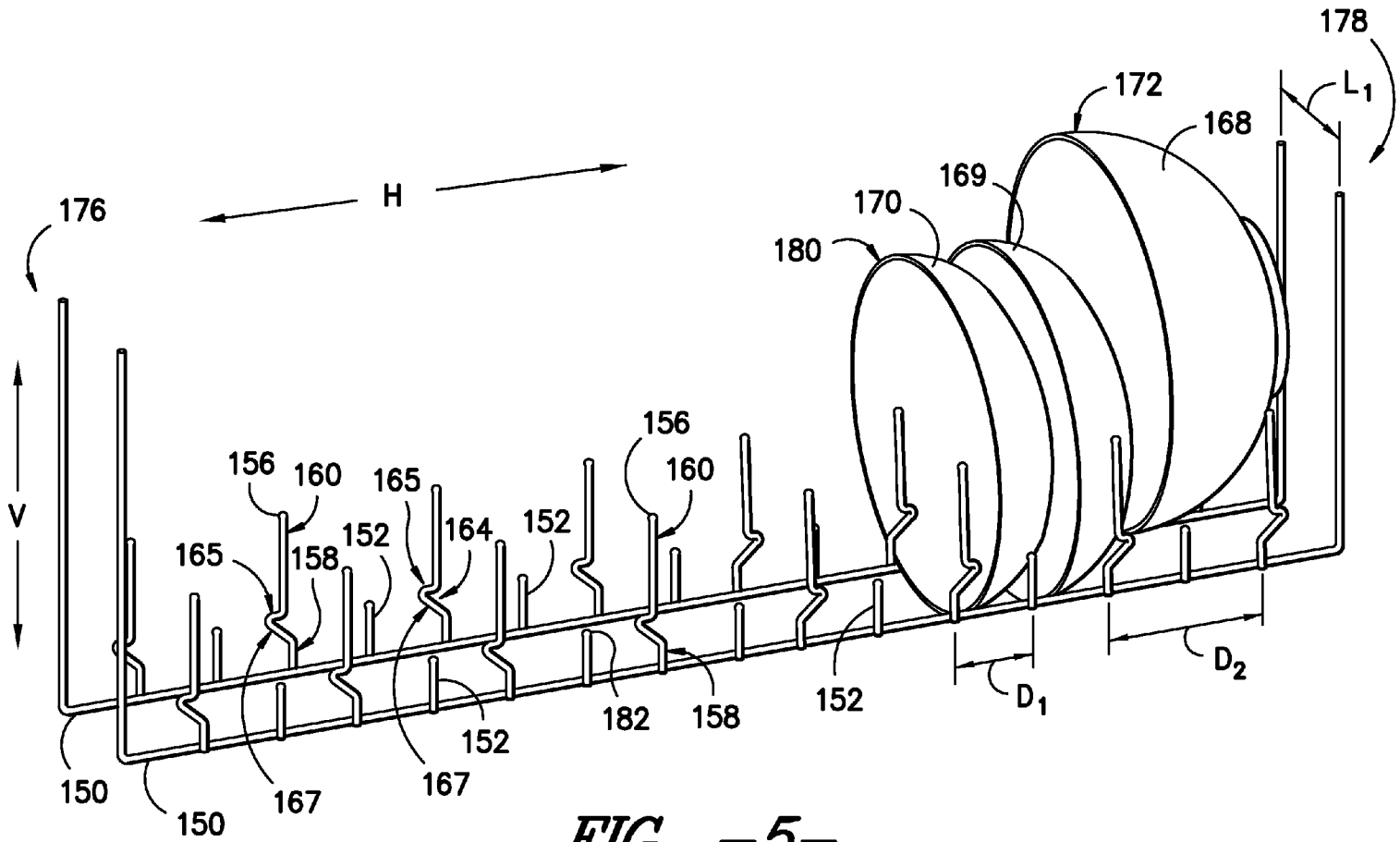
FIG. 5 is a perspective view of certain horizontal and vertical members of a rack assembly illustrating an exemplary embodiment of the present invention. The members are shown in isolation from the rest of the rack assembly for purposes of additional clarity in describing the invention. The members shown in FIG. 5 are also shown with slightly heavier line weights in FIG. 3.

As shown in isolation in FIG. 5, rack 130 includes vertical members that are particularly constructed for the receipt of both large and small bowls. By way of example, large bowl 168 is received into an elevated position beside smaller bowls 169 and 170 placed at a lower position. Only three bowls are shown for purposes of illustration—it being understood that additional bowls could also be placed onto rack 130. As shown, bowls 168, 169, and 170 are positioned within rack 130 in a vertical (or "on edge") orientation whereby such are supported in part along their rims 172 and 180. This orientation is more efficient than placing bowls in a horizontal position where more space would be required. At the same time, the orientation shown in FIG. 5 allows for water and detergent to be sprayed onto the surfaces of bowls 168, 169, and 170 so that proper cleaning can occur.

Continuing with FIGS. 3-5, rack 130 includes a plurality of elongated base members 150 that extend along the horizontal direction H in a parallel, spaced apart relationship between the front 176 and back 178 (FIG. 5) of rack 130. The amount of spacing $L_1$ between members 150 can be determined by e.g., the size of the bowls for which cleaning with dishwasher 100 is anticipated. Base members 150 form part of the horizontal bottom 131 of rack 130.

Attached to base members 150 are a plurality of elongated first members 152 that each extend, parallel to each other, along the vertical direction V. First members 152 are located on base members 150 and are spaced apart from each other along both the vertical direction V and horizontal direction H. More particularly, first members 152 on the same base member 150 are positioned spaced apart from each other along the length of such base member 150. Additionally, for each bowl to be supported, first members 152 are provided in pairs with one member 152 of each pair located on different base members 150 and spaced apart from each other by a distance $L_1$ due to the lateral spacing between base members 150. First members 152 are attached at a bottom end to base member 150 and have a ball-shaped tip 182 at their top end. As shown in FIG. 5, pairs of ball-shaped tips 182 contact the side of one of the small bowls 170 so as to support the positioning of this bowl within rack 130.

A plurality of elongated second members 156 are also attached to base members 150. Second members 156 each extend along the vertical direction and in a manner that is parallel to one other. Second members 156 are also spaced apart from each other along both the vertical direction V and horizontal direction H. More particularly, second members 156 on the same base member 150 are positioned spaced apart from each other along the length of such base member 150. Additionally, for each bowl to be supported, second members 156 are provided in pairs with one member 156 of each pair located on different base members 150 and spaced apart from each other by a distance $L_1$ due to the lateral spacing between base members 150. As shown most clearly in FIG. 5, first members 152 and second members 156 are connected to base member 150 in an alternating manner along the length of base member 150.

Second member 156 includes three different sections or parts. At its bottom, second member 156 has a first vertical section 158 that is attached to base member 150. For its top, second member 156 has a second vertical section 160. In order to accommodate small bowls 169 and 170, first section 158 and second section 160 are offset or staggered along the vertical direction.

A bent section 164 is located between first vertical section 156 and second vertical section 160. Bent section 164 has a V-shape that provides a horizontal section 165 and an angled section 167. Horizontal sections 165 support large bowl 168 between second members 156. More particularly, the horizontal sections 165 provide a resting place or shelf for the rim 172 of large bowl 168 a shown in FIG. 5.

Accordingly, as described above, rack assembly 130 provides for the receipt and proper positioning of both small and large bowls in dishwasher 100. Although shown in use with upper rack assembly 130, it will be understood that the present invention could also be used with lower rack assembly 132, or both. Additionally, the spacing between base members 150 ($L_1$), between first and second members 152 and 156 ($D_1$), and/or between second member 156 ($D_2$) is not limited to the dimensions or relative dimensions shown in the figures. These dimensions may be adjusted to accommodate different bowl sizes. In addition, while the present embodiment has been described with base members extending from the front 176 to the back 178 (FIG. 5) of rack 130, it will be understood that other orientations may be used as well—including an orientation that is perpendicular to the one shown in the figures.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher rack assembly, comprising:

a plurality of static elongated base members extending along the horizontal direction in a parallel, spaced apart relationship;

a plurality of static elongated first members extending along the vertical direction in a parallel, spaced apart relationship, said first members attached to said base members and extending perpendicularly from said base members; and, a plurality of static elongated second members extending along the vertical direction in a parallel, spaced apart relationship, said second members attached to said base members in an alternating manner with said first members along the horizontal direction, wherein said first members and said second members are non-intersecting, and wherein said second members each comprise:

a first vertical section attached to one of said base members and extending perpendicularly from said base member;

a second vertical section that is perpendicular to said base member; and, a bent section positioned between, and attached to, the first vertical section and the second vertical section, and wherein said first members are provided in pairs and disposed horizontally along said base members alternately with said second members with one member of each pair located on different base members and spaced apart from each other by a fixed distance, and wherein said first members extend from said base members a vertical distance no greater than the top of said bent section of said second members.

2. A dishwasher rack assembly as in claim 1, wherein said bent section further comprises:

a horizontal section for supporting a dish placed thereon; and, an angled section connected between the first vertical section and the horizontal section of said second member.

3. A dishwasher rack assembly as in claim 1, wherein the second vertical section is offset along the vertical direction from the first vertical section.

4. A dishwasher rack assembly as in claim 1, wherein the orientation of the bent section of the second members is divided between different sides of the dishwasher rack assembly.

5. A dishwasher rack assembly as in claim 1, wherein said first and second members are spaced apart by a distance along said base members that is configured for the depth of a dish that will rest upon said base members.

6. A dishwasher rack assembly as in claim 1, wherein said second members are spaced apart by a distance along said base members that is configured for the height of a dish that will rest upon the bent section of said second member without contacting said base member.

7. A dishwasher rack assembly as in claim 1, wherein said first members have an unattached end that is ball-shaped.

8. A dishwasher rack assembly as in claim 7, wherein the unattached end is configured to support the side of a bowl.

9. A dishwasher rack assembly as in claim 1, wherein the bent section of said second member is configured to support the rim of a bowl.

10. A dishwasher having a wash chamber for the receipt of dishes, the dishwasher defining horizontal and vertical directions, the dishwasher comprising:

a dishwasher rack assembly movably received into the wash chamber, the dishwasher rack assembly comprising:

a pair of static elongated base members extending parallel to each other along the horizontal direction;

a plurality of pairs of static vertically-oriented, spaced apart first members extending perpendicularly from said base members; and a plurality of pairs of static vertically-oriented, spaced apart second members extending perpendicularly from said base members in a spaced, non-intersecting relationship to said first members, said second members comprising a V-shaped section along their length for the support of the dishes, and, wherein said first members are provided in pairs and disposed horizontally along said base members alternately with said second members with one member of each pair located on different base members and spaced apart from each other by a fixed distance, and wherein said first members extend from said base members a vertical distance no greater than the top of said V-shaped section of said second members.

11. A dishwasher as in claim 10, wherein said base members comprises elongated wire members that are perpendicular to said first and second members.

12. A dishwasher as in claim 10, wherein said second members further comprise:

a first vertical section; and, a second vertical section;

wherein the V-shaped section of said second member is connected between the first and second vertical sections.

13. A dishwasher as in claim 12, wherein the second vertical section is offset along the vertical direction relative to the first vertical section.

14. A dishwasher as in claim 12, wherein said first vertical section is shorter than said second vertical section.

15. A dishwasher as in claim 10, wherein said first members have a ball-shaped tip.

* * * * *